US005167598A

United States Patent [19]

Sands

[11] Patent Number: 5,167,598

[45] Date of Patent: Dec. 1, 1992

[54] RUNNER'S ARM SWING HOLDER

[76] Inventor: Francis N. Sands, 111 S. Main St., Middlebury, Vt. 05753

[21] Appl. No.: 855,847

[22] Filed: Mar. 20, 1992

[51] Int. Cl.[5] ..... A63B 71/00

[52] U.S. Cl. ..... 482/74; 482/148; 602/20

[58] Field of Search ..... 482/74, 55, 105, 148; 602/5, 4, 15, 20, 878, 892

[56] References Cited

U.S. PATENT DOCUMENTS

| | | | |
|---|---|---|---|
| 364,942 | 6/1881 | Lee | 602/20 |
| 2,700,383 | 1/1955 | Moodie | 602/20 |
| 3,640,273 | 2/1972 | Ray | 602/5 |
| 4,489,716 | 12/1984 | Blackwood et al. | 602/20 |
| 4,896,660 | 1/1990 | Scott | 602/20 |
| 5,060,638 | 10/1991 | Bodine, Jr. | 128/878 |

*Primary Examiner*—Richard J. Apley
*Assistant Examiner*—Lynne A. Reichard
*Attorney, Agent, or Firm*—John J. Welch, Jr.

[57] ABSTRACT

The instant invention comprises a flat bottom surface, a flat posterior surface and two flat pentagonal lateral surfaces all jointed together to form one hollow unit and with a pair of parallel horizontal aperture slits of equal length through which banding is threaded, cut equidistantly from the respective bottom and leading edges of two flat pentagonal lateral surfaces and with a pair of parallel vertical aperture slits of equal length through which a second piece of banding is threaded, cut equidistantly from the respective top and posterior edges of two flat pentagonal lateral surfaces.

1 Claim, 1 Drawing Sheet

RUNNER'S ARM SWING HOLDER

BACKGROUND OF THE INVENTION

1. The Field of Invention:

The instant invention pertains to devices such as would be helpful in facilitating muscle memory in the arms of competitive runners. This invention serves to promote optimal proper so-called right-angled arm swinging by competitive runners while racing. Such so-called right-angled arm swinging serves to enhance running velocity by minimizing arm waving during running and hence minimizing body drag and wasted energy.

2. A Description of Prior Art

The inventor is not aware of any prior art that in any way relates to the instant invention except possibly such art as has been referenced in the First Office Action regarding this application, to wit:

| Inventor | Invention | Patent No. | Date |
|---|---|---|---|
| 1. W. J. Crawford | Surgical Splint | 2,409,195 | 6/22/43 |
| 2. V. B. Moodie | Limb Splint | 2,700,383 | 11/15/51 |
| 3. J. C. Donelan | Arm Restraining Device | 2,704,069 | 7/21/53 |
| 4. Rodriguez | Jogger's Aid | 4,337,938 | 7/6/82 |
| 5. Chambers | Adjustable Arm Swing | 4,625,719 | 12/2/86 |

SUMMARY OF THE INVENTION

1. A Brief Description of the Invention

The instant invention consists of a flat rectangular bottom surface, two flat pentagonal lateral surfaces, and a flat rectangular posterior surface. All of said surfaces are jointed together at right angles to one another to form one complete hollow unit. One first horizontal aperture slit of a given length is cut into the base of the first one of said two flat pentagonal lateral surfaces. This aperture slit is cut just behind the leading edge of and parallel with the bottom edge of this first pentagonal lateral surface. Another second horizontal aperture slit of a length equal to that of the abovesaid first aperture slit is cut into the base and parallel with the bottom edge of the other one of the two flat pentagonal lateral surfaces just behind the leading edge of this other pentagonal lateral surface. Both of these horizontal aperture slits are parallel to one another and likewise lie directly across from one another. A first vertical aperture slit of a given length is cut into the said first one of these two flat pentagonal lateral surfaces just below the top edge of the first flat pentagonal lateral surface and parallel with and just anterior to the posterior edge of the first pentagonal lateral surface. A second vertical aperture slit of a length equal to that of the first vertical aperture slit is cut into the said other one of these two flat pentagonal lateral surfaces just below the top edge of this other flat pentagonal lateral surface and parallel with and just anterior to the posterior edge of this other flat pentagonal lateral surface. Both of these vertical aperture slits are parallel to one another and likewise lie directly across from one another. A first piece of banding is threaded through the horizontal pair of aperture slits. A second piece of banding is threaded through the vertical pair of aperture slits. The first piece of banding is then tied or fastened about the forearm of a runner. The second piece of banding is then tied about the biceps muscle of said runner's same arm. The device thus so tied in place serves to hold the runner's arm fast in such a manner that the upper arm and forearm of said runner's arm forms a right angle.

One device is used on the runner's right arm. A second device is used on a runner's left arm.

2. The Object of the Invention

The object of this invention is to promote the development of muscle memory on the part of competitive runners such that during races being run by them, after having ran a number of practice races with one of these devices properly tied onto each arm, they will have come to reflexively hold their arms at ninety (90) degree angles, forearm to biceps as they are swinging their arms continuously while racing.

The inventor who has been a track and field coach for decades and who has long been a student of running times in terms of running form is clear on the point that proper right-angle arm swinging during racing calculated to save energy and minimize drag is a technique that has proven to be one very difficult to teach to prospective competitive racers.

The inventor is however likewise clear on the point that utilization of this device by such prospective competitive racers will serve to greatly facilitate their mastery of this technique much moreso that via mere coaching along.

A BRIEF DESCRIPTION OF THE DRAWINGS

A DETAILED DESCRIPTION OF THE PREFERRED EMBODIMENTS

Figure 1:
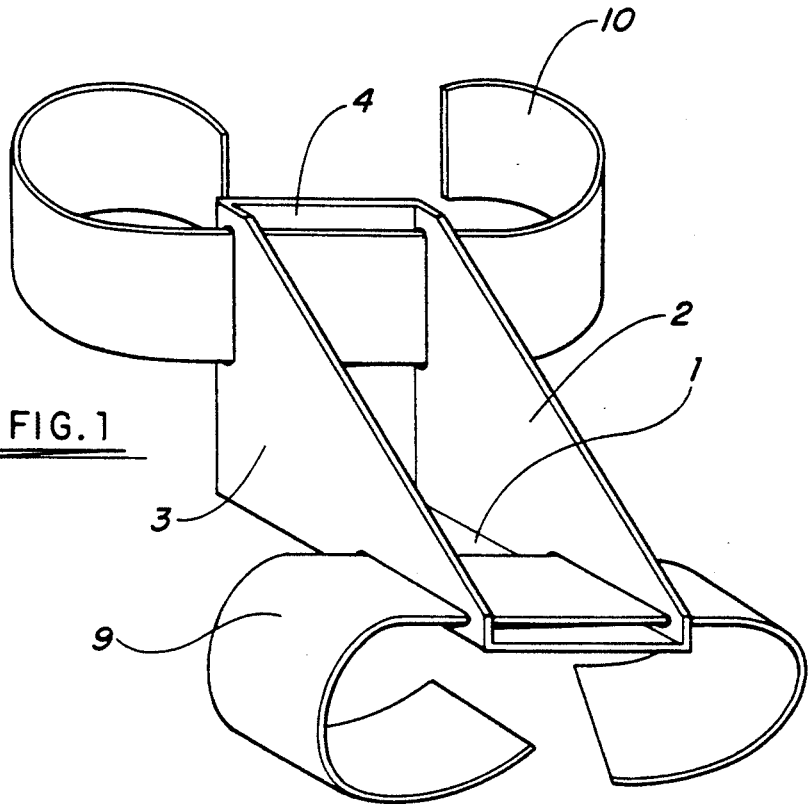
FIG. 1 is an anterolateral perspective view of the invention.
Figure 2:
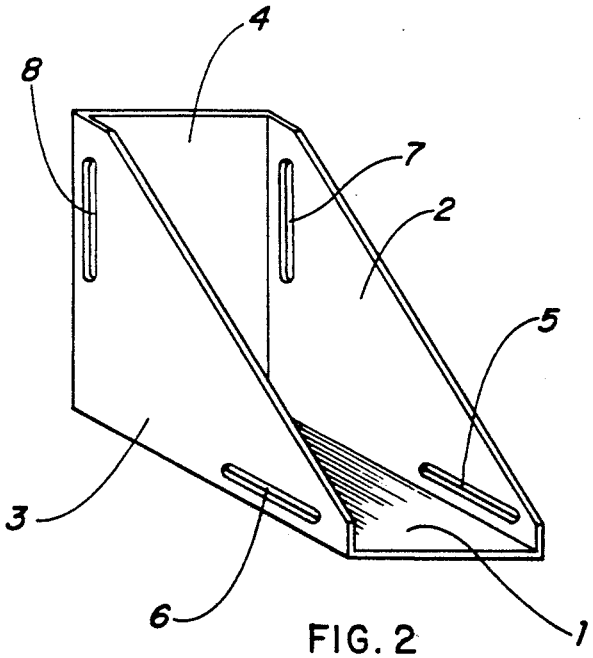
FIG. 2 is an anterolateral perspective view of the invention absent its two pieces of banding that serve to enable it to be fastened to a runner's arm.
Figure 3:
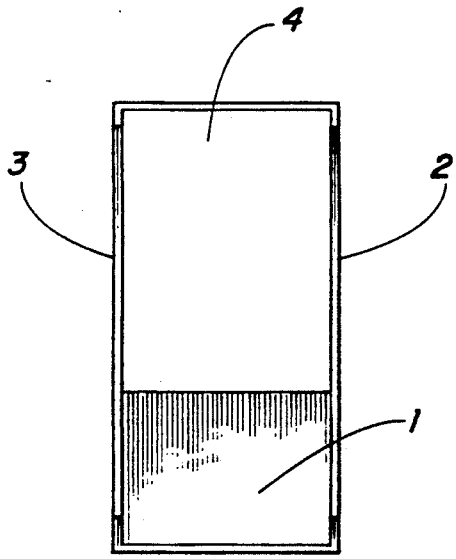
FIG. 3 is a frontal view of the invention absent its two pieces of banding that serve to enable it to be fastened to a runner's arm.

With regards to FIG. 1, the invention consists of a flat rectangular bottom surface (1) two flat pentagonal lateral surfaces (2) and (3) and a flat rectangular posterior surface (4). All of these surfaces are permanently jointed together at right angles to one another to form one complete hollow unit. One first horizontal aperture slit (5) of a given length as shown in FIG. 2 is cut into the base of the first of these two flat pentagonal lateral surfaces, to wit, flat pentagonal lateral surface (2). This aperture slit (5) is cut just behind the leading edge of and parallel with the bottom edge of flat pentagonal lateral surface (2). Another second horizontal aperture slit (6) also shown in FIG. 2 and of a length equal to that of the first aperture slit (5) is cut into the base of and parallel with the bottom edge of the other one of these two flat pentagonal lateral surfaces, to wit, flat pentagonal lateral surface (3) just behind the leading edge of flat pentagonal lateral surface (3). Both of these aperture slits (5) and (6) are parallel to one another and likewise lie directly across from one another. First vertical aperture slit (7) of a given length as shown in FIG. 2 is cut into flat pentagonal lateral surface (2) just below the top edge of flat pentagonal lateral surface (2) and parallel with and just anterior to the posterior edge of pentagonal lateral surface (2). Second vertical aperture slit (8) as shown in FIG. 2 of a length equal to that of first vertical aperture slit (7) is cut into the other one of the two flat pentagonal lateral surfaces, to wit, into flat pentagonal lateral surface (3) just below the top edge of flat pentagonal lateral surface (3) and parallel with and just anterior to the posterior edge of flat pentagonal lateral surface (3). Both vertical aperture slits (7) and aperture slit (8) as shown in FIG. 2 are parallel to one another and likewise lie directly across from one another. As shown in FIG. 1 a first piece of banding (9) is threaded through the horizontal pair of aperture slits, to wit, horizontal aperature slit (5) which slit is shown in FIG. 2 and horizontal aperture slit (6) which slit is shown in FIG. 2. As shown in FIG. 1 a second piece of banding (10) is threaded through the vertical pair of aperture slits, to wit, vertical aperture slit (7) which slit is shown in FIG. 2 and vertical aperture slit (8) which slit is shown in FIG. 2. Banding (9) is then tied or fastened about the forearm of a runner. Banding, (10) is then tied about the biceps muscle of said runner's same arm. The device thus so tied in place serves to hold the runner's arm fast in such a manner that the upper arm and forearm of said runner's arm forms a right angle.

One device is tied onto a runner's right arm. Another same device is tied onto that runner's left arm.

Each arm of a given would-be competitive runner is then so held by the devices aforesaid such that during practice racing, such a runner is forced to get used to arm swinging with arms held at right angles. Eventually, with enough practice races run with such devices, one on each arm, such a runner will have developed the degree of muscle memory necessary to enable such a runner to so hold and swing the arms during competitive racing without the need to any longer wear these devices.

What is claimed is:

1. A Runner's Arm Swing Holder, comprising:

(a) a flat rectangular bottom surface;

(b) a flat rectangular posterior surface permanently joined to said flat rectangular bottom surface;

(c) a first flat pentagonal lateral surface permanently joined to said flat rectangular bottom surface and said flat rectangular posterior surface;

(d) a second flat pentagonal lateral surface positioned parallel to said first flat pentagonal lateral surface and likewise permanently joined to said flat rectangular bottom surface and permanently joined to said flat rectangular posterior surface;

(e) a first horizontal aperture slit cut into the base of said first flat pentagonal lateral surface and running parallel to the bottom edge of said first flat pentagonal lateral surface and located just behind the leading edge of said first flat pentagonal lateral surface;

(f) a second horizontal aperture slit cut into the base of said second flat pentagonal lateral surface positioned parallel to said first horizontal aperture slit and running parallel to the bottom edge of said second flat pentagonal lateral surface having a length equal to the length of said first horizontal aperture slit and located just as far above the bottom edge of said second flat pentagonal lateral surface as said first horizontal slit is above the bottom edge of said first flat pentagonal lateral surface and located just as far behind the leading edge of said second flat pentagonal lateral surface as said first horizontal aperture slit is behind the leading edge of said first flat pentagonal lateral surface;

(g) a first vertical aperture slit cut into said first flat pentagonal lateral surface parallel with and just anterior to the posterior edge of said first flat pentagonal lateral surface and just below the top edge of said first flat pentagonal lateral surface;

(h) a second vertical aperture slit cut into said second flat pentagonal lateral surface just anterior to the posterior edge of said second flat pentagonal lateral surface and just below the top edge of said second flat pentagonal lateral surface which said second vertical aperture slit is of length equal to the length of said first vertical aperture slit and cut just as far below the top edge of said second flat pentagonal lateral surface as said first vertical aperture slit is cut below the top edge of said first flat pentagonal lateral surface and cut just as anterior to the posterior edge of said second flat pentagonal lateral surface as said first vertical aperture slit is cut anterior to the posterior edge of said first flat pentagonal lateral surface;

(i) a first piece of banding threaded through each of said first horizontal aperture slit and said second horizontal aperture slit;

(j) a second piece of banding threaded through each of said first vertical aperture slit and said second vertical aperture slit.

* * * * *